US009811032B2

(12) United States Patent
Koga et al.

(10) Patent No.: US 9,811,032 B2
(45) Date of Patent: Nov. 7, 2017

(54) FIXING BELT, FIXING DEVICE, AND IMAGE FORMING APPARATUS

(71) Applicant: Konica Minolta, Inc., Tokyo (JP)

(72) Inventors: Hirofumi Koga, Tokyo (JP); Izumi Mukoyama, Tokyo (JP); Naoko Uemura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/176,438

(22) Filed: Jun. 8, 2016

(65) Prior Publication Data

US 2016/0363897 A1 Dec. 15, 2016

(30) Foreign Application Priority Data

Jun. 10, 2015 (JP) ..... 2015-117519

(51) Int. Cl.
*G03G 15/20* (2006.01)

(52) U.S. Cl.
CPC ..... *G03G 15/2057* (2013.01); *G03G 15/2053* (2013.01); *G03G 2215/2032* (2013.01)

(58) Field of Classification Search
CPC ..... G03G 15/2053; G03G 15/2057; G03G 15/206; G03G 2215/2032
See application file for complete search history.

(56) References Cited

U.S. PATENT DOCUMENTS

2008/0031661 A1* 2/2008 Katada ..... G03G 15/2039 399/329
2011/0045310 A1* 2/2011 Kishino ..... C08G 73/1042 428/474.4

FOREIGN PATENT DOCUMENTS

JP 2001-296763 A 10/2001
JP 2006317505 A 11/2006

OTHER PUBLICATIONS

Notice of Reasons for Rejection dated Jun. 6, 2017 from Japanese Patent Application No. JP 2015-117519 and English translation; Total of 7 pages.

* cited by examiner

*Primary Examiner* — Hoang Ngo
(74) *Attorney, Agent, or Firm* — Lucas & Mercanti, LLP

(57) ABSTRACT

A fixing belt includes a base layer made of a heat-resistant resin, an elastic layer made of an elastic material, and a releasing layer, which are laminated in this order, and the difference between the maximum value and the minimum value of viscoelastic modulus within a range of 100 to 200° C. is 0.8% or less. Further, the viscoelastic modulus of the fixing belt within the range of 100 to 200° C. is within a range of 50 to 62%.

5 Claims, 3 Drawing Sheets

FIXING BELT, FIXING DEVICE, AND IMAGE FORMING APPARATUS

CROSS REFERENCE TO RELATED APPLICATIONS

This application is entitled to and claims the benefit of Japanese Patent Application No. 2015-117519, filed on Jun. 10, 2015, the disclosure of which including the specification, drawings and abstract is incorporated herein by reference in its entirety.

BACKGROUND OF THE INVENTION

1. Field of the Invention

The present invention relates to a fixing belt, a fixing device, and an image forming apparatus.

2. Description of Related Art

Conventionally, electrophotographic image forming apparatuses including copiers, and laser beam printers employ fixing devices in which a heated fixing belt is brought into contact with a transfer material bearing an unfixed toner image to fix the toner image to the transfer material. As such fixing devices, a fixing device having a fixing belt, and two or more rollers including a heating roller and pivotally supporting the fixing belt (e.g., Japanese Patent Application Laid-Open No. 2006-317505: Patent Literature 1; hereinafter, referred to as PTL 1). Since the fixing belt has relatively small thermal capacity, the fixing belt is excellent in fixing a toner image to a transfer material, and thus contributes to the speedup of image formation.

The fixing device in the image forming apparatus disclosed in PTL 1 includes an endless fixing belt, a fixing roller and a heating roller pivotally supporting the fixing belt, a pressure roller being pressed toward the fixing roller with a predetermined pressure with the fixing belt being interposed therebetween, and a local heating means that heats the heating roller. In the image forming apparatus disclosed in PTL 1, when a transfer material is nipped by the pressure roller and the fixing belt heated by the heating roller, wax contained in toner is melted to exude to the transfer material to thereby fix the toner image to the transfer material. At this time, the contact between the fixing belt and the transfer material allows the temperature of the fixing belt to be lowered temporarily. The fixing belt whose temperature is lowered is heated to the original temperature by the local heating means. Thus, the image forming apparatus disclosed in PTL 1 forms an image without gloss unevenness by keeping the temperature of the fixing belt constant when fixing the toner image.

However, in the image forming apparatus disclosed in PTL 1, consideration is given neither to the difference in the decrement in temperature between areas of the fixing belt corresponding to areas of the transfer material on which an image is formed and on which an image is not formed, nor to the temperature of the fixing belt in the case of continuous printing of transfer materials of different sizes. That is, the image forming apparatus disclosed in PTL 1 has a room for improvement in gloss unevenness.

SUMMARY OF THE INVENTION

In view of the foregoing, an object of the present invention is to provide a fixing belt, a fixing device, and an image forming apparatus which have separativeness with respect to a recording medium and can suppress gloss unevenness even when the fixing belt has different temperatures in fixing a toner image.

In order to achieve at least one of the above-described objects, in a fixing belt reflecting an aspect of the present invention, a base layer made of a heat-resistant resin, an elastic layer made of an elastic material, and a releasing layer are laminated in this order, and the difference between a maximum value and a minimum value of viscoelastic modulus within a range of 100 to 200° C. is 0.8% or less.

In order to achieve at least one of the above-described objects, a fixing belt reflecting an aspect of the present invention includes an endless fixing belt, two or more rollers including a heating roller for heating the fixing belt, the two or more rollers pivotally supporting the fixing belt, and a pressure roller disposed to be relatively biased against one of the rollers with the fixing belt being interposed therebetween. The fixing belt is a fixing belt according to an embodiment of the present invention.

Further, in order to achieve at least one of the above-described objects, an image forming apparatus reflecting an aspect of the present invention includes an image forming section configured to form a toner image on a recording medium by an electrophotographic process, and a fixing device according to an embodiment of the present invention configured to heat and press an unfixed toner image formed on the recording medium to fix the unfixed toner image on the recording medium.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention is described in detail with reference to the attached drawings.

(Configuration of Image Forming Apparatus)

Figure 1:
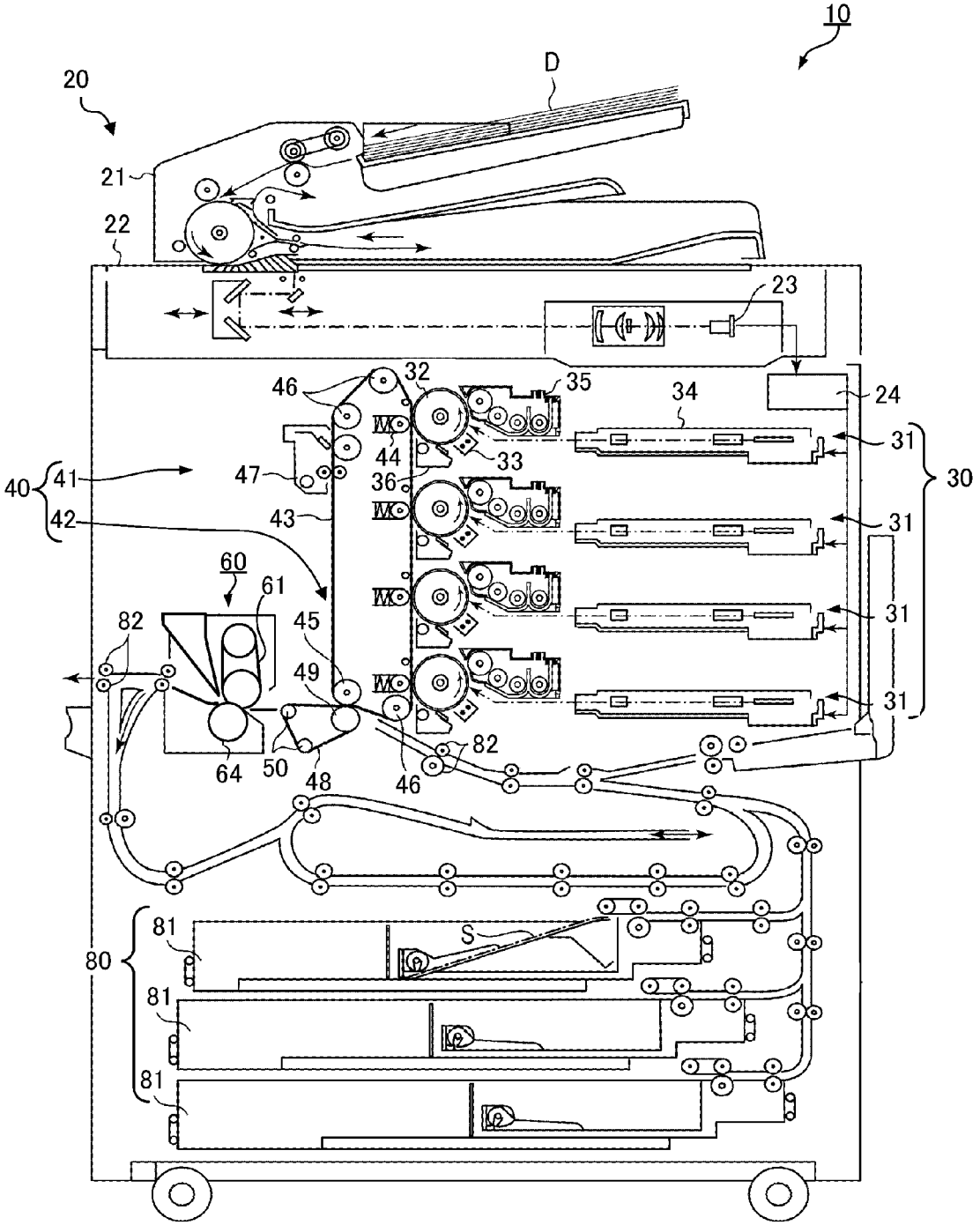
FIG. 1 illustrates a configuration of an image forming apparatus according to an embodiment of the present invention.
Figure 2:
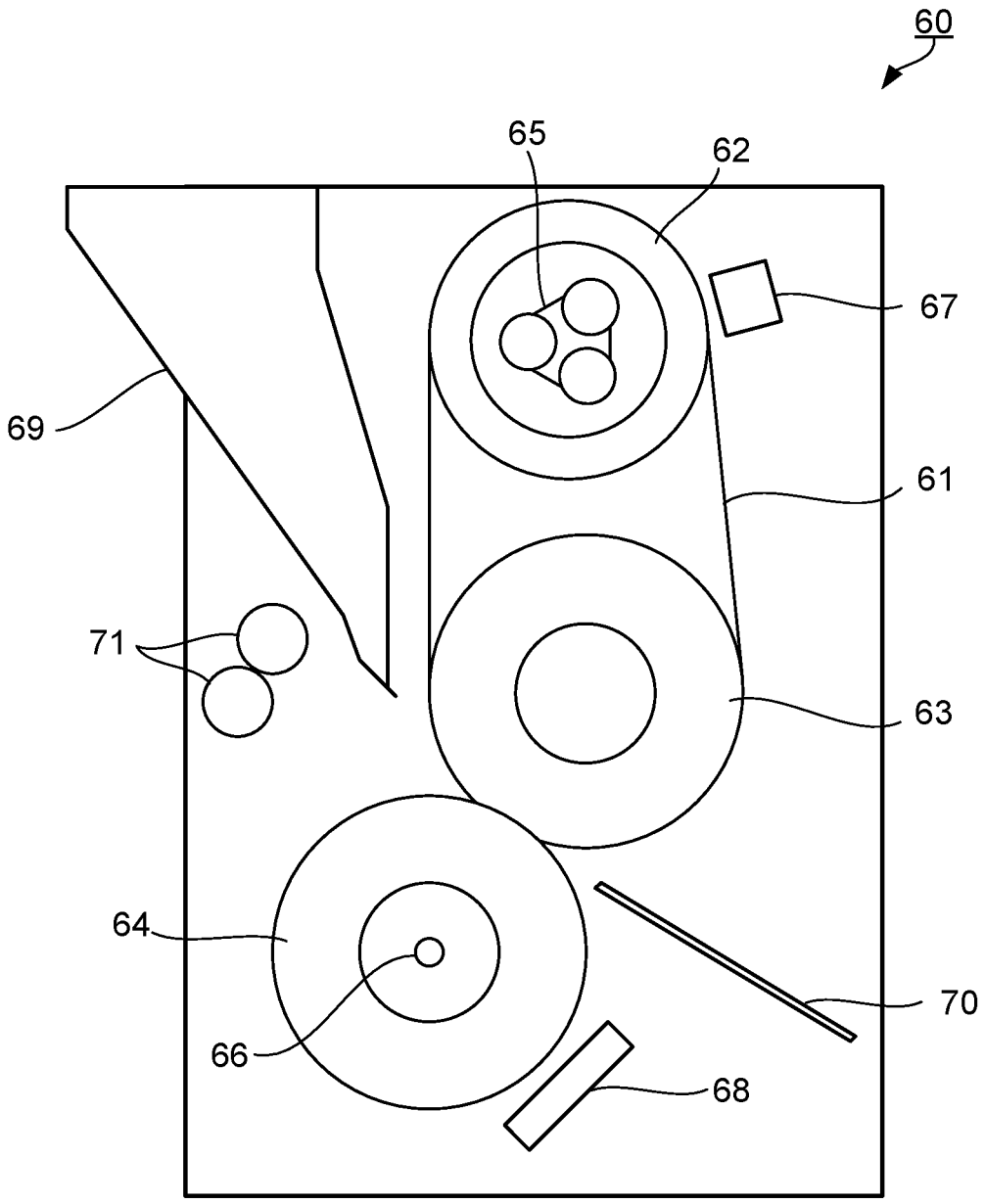
FIG. 2 illustrates a configuration of a fixing device.

FIG. 1 illustrates the configuration of image forming apparatus 10, and FIG. 2 illustrates the configuration of fixing device 60.

As illustrated in FIG. 1, image forming apparatus 10 includes image reading section 20, image forming section 30, intermediate transfer section 40, fixing device 60, and recording medium conveyance section 80.

Image reading section 20 reads an image from document D, and obtains image data for forming an electrostatic latent image. Image reading section 20 includes feeding device 21, scanner 22, CCD sensor 23, and image processing section 24.

Image forming section 30 includes four image forming units 31 corresponding to the respective colors of yellow, magenta, cyan and black, for example. Image forming unit 31 includes photoconductor drum 32, charging device 33, exposing device 34, developing device 35, and cleaning device 36.

Photoconductive drum 32 is an organic photoconductor of a negative charge type having photo conductivity, for example. Charging device 33 is a corona charger, for example. Charging device 33 may also be a contact charging device that brings a contact charging member such as a charging roller, a charging brush and a charging blade into contact with photoconductor drum 32 for charging. Exposing device 34 irradiates charged photoconductor drum 32 with light to form an electrostatic latent image. Exposing device 34 is a semiconductor laser, for example. Developing device 35 supplies toner to photoconductor drum 32 on which an electrostatic latent image is formed to form a toner image according to the electrostatic latent image. Developing device 35 is a publicly known developing device in an electrophotographic image forming apparatus, for example. Cleaning device 36 removes remaining toner of photoconductor drum 32. As used herein, the term "toner image" refers to a state where toner is collected into an image.

As the toner, known toner can be used. The toner may be either a one-component developer, or a two-component developer. The one-component developer is composed of toner particles. The two-component developer is composed of toner particles and carrier particles. The toner particles are composed of toner base particles and an external additive such as silica adhered to the surface thereof. The toner base particles are composed of a binder resin, a colorant and wax, for example.

Intermediate transfer section 40 includes primary transfer unit 41 and secondary transfer unit 42.

Primary transfer unit 41 includes intermediate transfer belt 43, primary transfer roller 44, backup roller 45, a plurality of first support rollers 46, and cleaning device 47. Intermediate transfer belt 43 is an endless belt. Intermediate transfer belt 43 is stretched by backup roller 45 and first support roller 46. When at least one of backup roller 45 and first support roller 46 is rotationally driven, intermediate transfer belt 43 travels on an endless path in one direction at a constant speed.

Secondary transfer unit 42 includes secondary transfer belt 48, secondary transfer roller 49, and a plurality of second support rollers 50. Secondary transfer belt 48 is an endless belt. Secondary transfer belt 48 is stretched by secondary transfer roller 49 and second support roller 50.

As illustrated in FIG. 2, fixing device 60 includes fixing belt 61, heating roller 62, first pressure roller 63, second pressure roller 64, heaters 65 and 66, first temperature sensor 67, second temperature sensor 68, airflow separation device 69, guide plate 70, and guide roller 71.

Figure 3A:
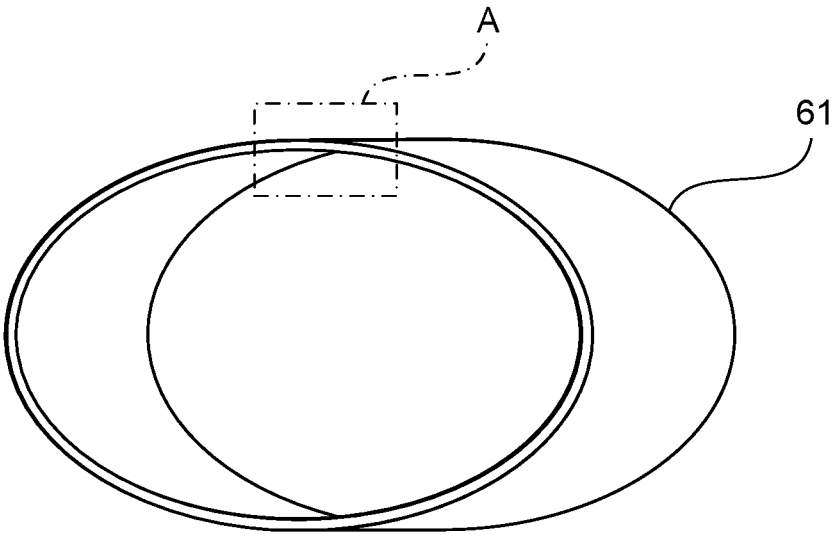
FIG. 3A schematically illustrates an example of a fixing belt according to an embodiment of the present invention.
Figure 3B:
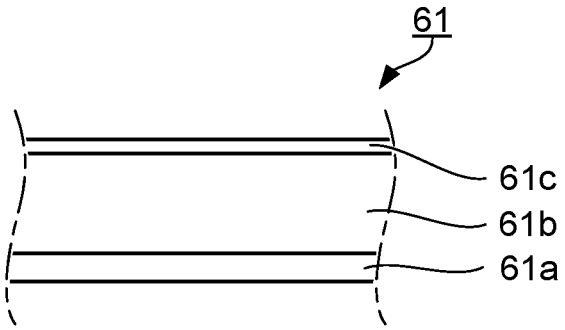
FIG. 3B is an enlarged view of area A illustrated in FIG. 3A.

Fixing belt 61 has base layer 61*a*, elastic layer 61*b* and releasing layer 61*c*, which are laminated in this order (see FIG. 3B). Fixing belt 61 is pivotally supported by heating roller 62 and first pressure roller 63, with base layer 61*a* being positioned inside, and releasing layer 61*c* being positioned outside. The tension of fixing belt 61 is 43N, for example. Since one feature of the present embodiment lies in fixing belt 61, the detailed description of fixing belt 61 will be set forth hereinafter.

Heating roller 62 includes a freely rotatable sleeve made of aluminum, and heater 65 disposed inside the sleeve. First pressure roller 63 includes, for example, a rotatable mandrel, and an elastic layer disposed on the outer peripheral surface of the mandrel.

Second pressure roller 64 is disposed to be opposed to first pressure roller 63 with fixing belt 61 being disposed therebetween. Second pressure roller 64 includes, for example, a freely rotatable sleeve made of aluminum, and heater 66 disposed inside the sleeve. Second pressure roller 64 is disposed in such a manner as to be freely brought closer to and separated from first pressure roller 63. When being brought closer to first pressure roller 63, second pressure roller 64 presses the elastic layer of first pressure roller 63 with fixing belt 61 being interposed therebetween, and thus forms a fixing nip portion which is a contacting portion with fixing belt 61.

First temperature sensor 67 is a device for detecting the temperature of fixing belt 61 heated by heating roller 62. Second temperature sensor 68 is a device for detecting the temperature of the outer peripheral surface of second pressure roller 64.

Airflow separation device 69 is a device for generating airflow from the downstream side of the movement direction of fixing belt 61 toward the fixing nip portion so as to facilitate separation of recording medium S from fixing belt 61.

Guide plate 70 is a member for guiding recording medium S having an unfixed toner image to the fixing nip portion. Guide roller 71 is a member for guiding the recording medium on which a toner image is fixed to the outside of image forming apparatus 10 from the fixing nip portion.

Returning to the description of FIG. 1, recording medium conveyance section 80 includes three sheet feed tray units 81 and a plurality of registration roller pairs 82. Recording medium S (standard sheets and special sheets in the present embodiment) discriminated based on their basis weight, size and the like is stored in respective sheet feed tray units 81 in advance on a predetermined type basis. Registration roller pairs 82 are disposed so as to form a desired conveyance path.

In such image forming apparatus 10, a toner image is formed on recording medium S conveyed from recording medium conveyance section 80 at intermediate transfer section 40 based on image data obtained at image reading section 20. Recording medium S on which the toner image is formed at intermediate transfer section 40 is conveyed to fixing device 60.

Fixing belt 61 in fixing device 60 is rotationally driven at a predetermined speed, and is heated to a desired temperature (e.g., 190° C.) by heater 65 under the feedback control of first temperature sensor 67, for example. Second pressure roller 64 is heated by heater 66 to a desired temperature (e.g., 180° C.) under the feedback control of second temperature sensor 68, for example. In synchronization with the arrival of recording medium S, second pressure roller 64 biases the outer peripheral surface of first pressure roller 63 with fixing belt 10 being interposed therebetween so as to form a fixing nip portion.

Recording medium S bearing an unfixed toner image is guided by guide plate 70 to the nip portion. Fixing belt 61 is brought into close contact with recording medium S to thereby allow the unfixed toner image to be immediately fixed to recording medium S. Further, recording medium S receives airflow from airflow separation device 69 at the downstream end of the fixing nip portion. This facilitates the separation of recording medium S from fixing belt 61. The recording medium separated from fixing belt 61 is guided by guide roller 71 to the outside of image forming apparatus 10.

(Configuration of Fixing Belt)

Next, fixing belt 61 is described in detail. FIG. 3A is a perspective view of fixing belt 61, and FIG. 3B is an enlarged view of area A illustrated in FIG. 3A.

As illustrated in FIGS. 3A and 3B, fixing belt 61 has base layer 61*a*, elastic layer 61*b*, and releasing layer 61*c*. Further, in fixing belt 61, base layer 61*a* is positioned inside, and releasing layer 61*c* is positioned outside.

Base layer 61*a* is made of a heat-resistant resin. The heat-resistant resin is appropriately selected from resins that are not modified or deformed in a temperature in which fixing belt 61 is used, which resin may be used alone or in combination. Examples of the heat-resistant resin include polyphenylene sulfide, polyarylate, polysulfone, polyether sulfone, polyetherimide, polyimide, polyamideimide and polyetheretherketone. For the heat-resistant resin, polyimide is preferable from the view point of heat-resistance.

Polyimide can be obtained through progression of dehydration/cyclization (imidization) reaction of polyamic acid, which is the precursor of polyimide, by heating at 200° C. or higher, or by using a catalyst. Polyamic acid may be a commercially available product, or may be manufactured by dissolving tetracarboxylic dianhydride and a diamine compound in a solvent and then causing polycondensation reaction by mixing/heating. Examples of the diamine compound and the tetracarboxylic dianhydride include compounds mentioned in Japanese Patent Application Laid-Open No. 2013-25120 in paragraphs 0123 to 0130.

As long as the effect of the present embodiment is obtained, base layer 61*a* may further contain components other than the heat-resistant resins. For example, the material of base layer 61*a* may further contain other resin components. The content of the heat-resistant resin in the material of base layer 61*a* is preferably 40 to 100 vol % from the viewpoint of moldability and the like.

Elastic layer 61*b* is made of an elastic material. Examples of the material (elastic material) of elastic layer 61*b* include elastic resin materials such as silicone rubbers, thermoplastic elastomer, and rubber materials. The elastic material is preferably silicone rubber.

The silicone rubbers may be used alone or in combination. Examples of the silicone rubbers include polyorganosiloxane or the thermally hardened products of polyorganosiloxane, and the addition reaction type silicone rubber mentioned in Japanese Patent Application Laid-Open No. 2009-122317. Examples of the polyorganosiloxane include dimethyl polysiloxane whose both ends are blocked with a trimethylsiloxane group and has a vinyl group on a side chain, which is mentioned in Japanese Patent Application Laid-Open No. 2008-255283.

From the viewpoint of sufficiently obtaining thermal conductivity and elasticity, for example, the thickness of elastic layer 61*b* is preferably 30 to 400 μm, more preferably 50 to 300 μm, and still more preferably 100 to 250 μm.

Elastic layer 61*b* may further contain components other than the elastic resin materials as long as the effect of the present embodiment can be obtained. For example, the elastic material may further contain a thermal conductive filler for enhancing the thermal conductivity of the elastic layer. Examples of the material of the filler include silica, metal silica, alumina, zinc oxide, aluminum nitride, boron nitride, silicon nitride, silicon carbide, carbon and graphite. The filler is not limited in its form, and may be spherical powder, unshaped powder, flat powder or fiber, for example.

The content of the elastic resin material in the elastic material is preferably 60 to 100 vol %, more preferably 75 to 100 vol %, and still more preferably 80 to 100 vol %.

Releasing layer 61*c* has suitable releasability to the toner. Releasing layer 61*c* is positioned at the exterior surface of fixing belt 61 that makes contact with recording medium S at the time of fixation. Examples of the material of releasing layer 61*c* include polyethylene, polypropylene, polystyrene, polyisobutylene, polyester, polyurethane, polyamide, polyimide, polyamideimide, alcohol-soluble nylon, polycarbonate, polyarylate, phenolic resin, polyoxymethylene, polyetheretherketone, polyphosphazene, polysulfone, polyether sulfone, polyphenylene sulfide, polyphenylene ether, polyparabanic acid, polyallylphenol, fluororesin, polyurea, ionomer, silicone, and their mixtures or copolymers. From the viewpoints of the releasability and the heat resistance, the material of releasing layer 61*c* is preferably fluororesin, and more preferably perfluoro-alkoxy fluororesin (PFA).

From the viewpoint of obtaining heat transmission, followability to deformation of the elastic layer and releasability, for example, the thickness of releasing layer 61*c* is preferably 5 to 40 μm, more preferably 10 to 35 μm, and still more preferably 15 to 30 μm.

As long as the effect of the present embodiment can be obtained, releasing layer 61*c* may further contain components other than the resin matrix material. For example, releasing layer 61*c* may further contain lubricant particles. Examples of the lubricant particles include fluororesin particles, silicone resin particles and silica particles.

From the viewpoints of thermal conductivity and flexibility for sufficiently following the deformation of the elastic layer, the content of the resin matrix material in the material of releasing layer 61*c* is preferably 70 to 100 vol %.

As long as the effect of the present embodiment can be obtained, fixing belt 61 may further contain layers other than the above-mentioned base layer 61*a*, elastic layer 61*b* and releasing layer 61*c*. Examples of such layers include a reinforcement layer.

The reinforcement layer is a layer for increasing the mechanical strength of fixing belt 61, and is, for example, disposed on the surface (the inner peripheral surface of base layer 61*a*) on the side opposite to elastic layer 61*b* and releasing layer 61*c* in fixing belt 61. The reinforcement layer may be composed of the heat-resistant resin, and the thickness thereof can be appropriately determined.

Fixing belt 61 can be produced by utilizing publicly known methods for producing a laminated fixing belt. For example, fixing belt 61 can be produced by a method including: a step of covering the exterior surface of an endless molded article made of a heat-resistant resin that serves as base layer 61*a*, with a tube that serves as releasing layer 61*c*; a step of injecting an elastic material or a precursor thereof between the molded article and the tube; and a step of heating and curing the elastic material or the precursor thereof as necessary.

The present inventors have studied the relationship among physical properties of the fixing belt, the fixation performance of a toner image to a recording medium, and the separativeness between the fixing belt and the recording medium, as follows. The physical properties of the fixing belt have large influence on the fixation performance of a toner image to recording medium S as well as on the exudation amount of wax contained in the toner. In particular, a fixing belt having high rubber hardness allows the toner to exude a large amount of wax at the time of fixation of a toner image, and thus is excellent in separativeness with respect to the recording medium. On the other hand, the fixing belt having high rubber hardness has decreased adhesiveness with respect to the recording medium, and thus is inferior in the fixation performance of a toner image to the recording medium. In view of the above, it can be considered that the separativeness and the fixation performance are both achieved by lowering viscoelastic modulus without increasing the rubber hardness. Here, silicone, which is one of the materials of the fixing belt, is known to have higher heat resistance and has less variation in physical properties including hardness due to temperature than other general-purpose rubber. However, the hardness of silicone undesirably varies between a temperature of the fixing belt at which a toner image is fixed thereto and a temperature thereof at which a toner image is not fixed thereto, and such variation in the hardness is considered to have an influence on the fixation performance of the toner image to the recording medium. Thus, due to the variations in the fixation condition (weighing capacity of the recording medium, conveyance speed of the recording medium, and temperature variation in the fixing belt) and the like, there undesirably occurs a difference in the fixation performance and the exudation amount of wax, resulting in differences in image quality. In consideration of the above, the present inventors have found that the suppression of variation in the viscoelastic modulus due to temperature allows pressing force and resilience on the surface of the fixing belt to be kept constant, and stabilizes the melting condition of toner (exudation amount of wax) to suppress the variation in image quality.

As described above, fixing belt 61 has base layer 61*a* made of a heat-resistant resin, elastic layer 61*b* made of an elastic material, and a releasing layer 61*c*, which are laminated in this order. The difference between the maximum value and the minimum value of the viscoelastic modulus of fixing belt 61 within a range of 100 to 200° C. is 0.8% or less. As used herein, the range "100 to 200° C." is a temperature zone of fixing belt 61, which is presumed during printing. The variation in the viscoelastic modulus indicates the variation in rubber physical properties of fixing belt 61. As used herein, the term "viscoelastic modulus" is a numerical value obtained taking the viscosity and elasticity of a substance into consideration. When the difference between the maximum value and the minimum value of the viscoelastic modulus of fixing belt 61 within a range of 100 to 200° C. is more than 0.8% by significantly varying the elastic component of the viscoelastic modulus, the exudation amount of wax contained in the toner is increased to cause memory, or fixing belt 61 fails to follow the irregularities on the surface of recording medium S, causing a defect in the fixation of the toner to recording medium S. On the other hand, when the difference between the maximum value and the minimum value of the viscoelastic modulus of fixing belt 61 within a range of 100 to 200° C. is more than 0.8% by significantly varying the viscous component of the viscoelastic modulus, the exudation amount of wax contained in the toner is decreased to cause a defect in the separation between fixing belt 61 and recording medium S.

The viscoelastic modulus of fixing belt 61 within a range of 100 to 200° C. is preferably within a range of 50 to 62%, more preferably 55% or more, and still more preferably 58% or more. When the viscoelastic modulus of fixing belt 61 within a range of 100 to 200° C. is less than 50%, the resilience of fixing belt 61 undesirably becomes too high, so that there is a concern that fixing belt 61 may not follow the irregularities on the surface of recording medium S, resulting in a defect in the fixation of the toner to recording medium S. On the other hand, when the viscoelastic modulus of fixing belt 61 within a range of 100 to 200° C. is more than 62%, the resilience of elastic layer 61*b* cannot be obtained, so that there is a concern that a defect may occur in the separation between fixation belt 61 and recording medium S.

The viscoelastic modulus can be obtained by generating a certain variation in a measurement subject (fixing belt 61 in the present embodiment) to track the deformation behavior thereof and by performing quantification using a Voigt model. The unit of the viscoelastic modulus is %. Further, the viscoelastic modulus can be represented by amount of viscous stress/amount of elastic stress +amount of viscous stress.

The viscoelastic modulus can be measured, for example, by a viscoelastometer (Vesmeter E-200DT; Wave Cyber Corp.). Here, Vesmeter is described briefly. Vesmeter applies a certain external force to a measurement subject to slightly deform the measurement subject. Then, a responsive behavior of restorative force is tracked by tracking the state of the measurement subject after the external force is removed. Finally, waveform analysis at the time of restoration is performed to measure the viscoelasticity.

The viscoelastic modulus can be typically adjusted as described below, although the adjustment method therefor varies depending on materials that constitute fixing belt 61 (mainly releasing layer 61*c*) and the like. Typically, the viscoelastic modulus tends to be lowered by increasing the elastic component. Further, the variation in the viscoelastic modulus tends to be decreased by increasing the glass transition temperature within a predetermined temperature range. Specifically, the viscoelastic modulus can be adjusted by increasing the crosslink density or increasing the molecular weight to increase the hardness, or with the compounding amount of a polymer type and a filler type. Further, the adjustment can be possible also by increasing the glass transition temperature.

The variation rate of the amount of viscous stress relative to the amount of elastic stress of fixing belt 61 within a range of 100 to 200° C. is preferably 0.1 or less. As used herein, the term "amount of elastic stress" refers to elastic modulus, and means properties such that, in a case where force is applied utilizing the properties of a spring, (in this case, stress in proportion to the force is generated), when the force is released, the shape immediately returns to its original shape. The unit of the amount of elastic stress is $N/m^2$. As used herein, the term "amount of viscous stress" refers to viscosity coefficient, and means properties such that, when force is applied or released, an object reacts in a delayed manner. The unit of the amount of viscous stress is $N \cdot s/m^2$. When the variation rate of the amount of viscous stress relative to the amount of elastic stress of fixing belt 61 within a range of 100 to 200° C. is more than 0.1, there is a concern that the variation in pressing force and resilience of the rubber may cause influence on the gloss of an image and separativeness.

According to the present embodiment, in an image formation method using an electrophotographic process in a high-speed machine having a biaxial belt type fixing device, favorable fixation can be achieved and paper jam can be prevented from occurring. Therefore, according to the present invention, further speedup, enhancement in performance and power saving in an electrophotographic image forming apparatus can be expected, and popularization of the image forming apparatuses can be expected.

As the effect of the present embodiment, it is possible to provide a fixing belt, a fixing device, and an image forming apparatus which have separativeness with respect to a recording medium and can suppress gloss unevenness even when the fixing belt has different temperatures in fixing a toner image.

EXAMPLES

The present invention is further specifically described with the following examples and comparative examples. In the following description, each operation is performed at room temperature (20° C.) unless otherwise noted. It is to be noted that the present invention is not limited to the examples and so forth.

Example 1

A cylindrical mandrel made of stainless-steel having an outer diameter of 60 mm was brought into close contact with the inner side of a belt base material made of a heat curable polyimide resin having an inner diameter of 99 mm, a length of 360 mm, and a thickness of 70 μm. Next, a cylindrical metal mold holding a PFA tube having a thickness of 30 μm on the inner peripheral surface thereof was provided on the outer side of the belt base material. Thus, the mandrel and the cylindrical metal mold were coaxially held, while forming a cavity therebetween. Next, silicone rubber material A was injected to the cavity and subjected to heat-curing, and an elastic layer of silicone rubber A having a thickness of 200 μm was produced. In this manner, fixing belt No. 1 in which the belt base material, the elastic layer of silicone rubber A, and the releasing layer made of PFA were stacked on top of one another in this order was produced.

The produced fixing belt No. 1 was fixed to an aluminum cylindrical substrate, heated from the inner side with a halogen heater, and measured in terms of viscoelasticity using a viscoelastometer (Vesmeter E-200DT; Wave Cyber Corp.). The viscoelastic modulus of the produced fixing belt at 100° C. was 61.0%. Further, the viscoelastic modulus was measured using this viscoelastometer at temperatures of from 100 to 200° C. at an increment of 10° C. It is to be noted that the following Table 1 only indicates the results at temperatures of 100° C., 150° C., and 200° C.

Silicone rubber material A is a composition obtained by mixing 100 parts by mass of dimethyl polysiloxane having a vinyl group on a side chain and 15 parts by mass of silica. In addition, silicone rubber A, which was produced under the same manufacturing condition as that of the elastic layer using silicone rubber material A, had a rubber hardness of 30, a tensile strength of 2.3 MPa, an extension of 400%, and a thermal conductivity of 0.3 W/m·K.

The rubber hardness of silicone rubber A was measured with durometer A using a rubber sheet for measurement having a thickness of 2.0 mm according to JIS K6301.

[Evaluation]

Fixing belt No. 1 was installed as a fixing belt of an electrophotographic image forming apparatus including a biaxial belt type fixing device illustrated in FIG. 2. The roller forming a fixing nip portion and pivotally supporting fixing belt No. 1 had a roller diameter of 60 mm, and the separation angle at a printing rate of 60 A4-plain sheets per minute in the fixing device was 73 degrees. In addition, Digital Toner HD+(Konica Minolta Inc.) was used as toner.

(1) Gloss Unevenness

A full-color copier (bizhub Pro C754; Konica Minolta Inc.) was used to form a predetermined toner image on a A3-size recording medium at a printing rate of 51 sheets per minute. As the recording medium, a plain sheet (80 g/m$^2$), a coated sheet (128 g/m$^2$), and a coated sheet (200 g/m$^2$) were used. The adhesion amount of toner to the recording medium was 11 g/m$^2$. Further, as the toner image, a solid outline letter is disposed at the center portion of the end portion of the recording medium in the conveyance direction, and an area other than the center portion was painted solid black. For the area of the outline letter and the area other than the area of the outline letter of the obtained image, the gloss level difference was evaluated as gloss unevenness according to the following criteria:

A: No gloss level difference is observed on an image

B: Gloss level difference is observed on an image (2) Separativeness

A full-color copier (bizhub PRESS C1070; Konica Minolta Inc.) was used to pass a recording medium on which an image was formed, in the wider width direction of the sheet at a rate of 60 sheets per minute to evaluate the separation performance. As the recording medium, "OK Kinfuji 85 (grain long) A4" was used. An arbitrary margin was formed at the end of the recording medium, and a whole-surface solid image (adhesion amount of 8.0 g/m$^2$) produced with two layers of magenta (red) and cyan was formed at an area other than the margin. The surface temperature of the fixing belt was set at 150 or 200° C. The separativeness at this time between the fixing belt and the recording medium on the side of the image was determined according to the following criteria:

A: Even when the end margin is 3 mm or less, a recoding medium is not curled, and is separated from the fixing belt B: When the end margin is within a range of more than 3 mm to less than 7 mm, a recoding medium is not curled, and is separated from the fixing belt C: When the end margin is not within a range of 7 mm or more to less than 10 mm, a recoding medium cannot be separated from the fixing belt D: When the end margin is less than 10 mm, a recoding medium cannot be separated from the fixing belt Examples 2 to 6 and Comparative Examples 1 to 3

Fixing belt No. 2 having an elastic layer made of silicone rubber B, fixing belt No. 3 having an elastic layer made of silicone rubber C, fixing belt No. 4 having an elastic layer made of silicone rubber D, fixing belt No. 5 having an elastic layer made of silicone rubber E, fixing belt No. 6 having an elastic layer made of silicone rubber F, Fixing belt No. C1 having an elastic layer made of silicone rubber G, fixing belt No. C2 having an elastic layer made of silicone rubber H, and fixing belt No. C3 having an elastic layer made of silicone rubber I were produced in a manner similar to that of silicone rubber A except that the type of the dimethyl polysiloxane having a vinyl group on a side chain, the mixing ratio, and the amount of the additive and the like are adjusted. In addition, in a manner similar to that of silicone rubber A, the physical properties of silicone rubbers B to I were measured. Further, the gloss unevenness and the separativeness are determined in a manner similar to that of Example 1 except that fixing belts Nos. 2 to 6, and C1 to C3 were used instead of fixing belt No. 1.

Various physical properties of silicone rubbers A to I and the evaluation results of fixing belts Nos. 1 to 6, and C1 to C3 are shown in Table 1. It is to be noted that "A" shown in Table 1 means the difference between the maximum value and the minimum value of the viscoelastic modulus, and "A stress amount" means the variation rate of the amount of viscous stress relative to the amount of elastic stress.

TABLE 1

| | Rubber | | Viscoelastic Modulus (%) | | | Δ | Δ Stress | Gloss | Separativeness | |
|---|---|---|---|---|---|---|---|---|---|---|
| | Type | Hardness | 100° C. | 150° C. | 200° C. | (%) | Amount | Difference | 150° C. | 200° C. |
| Ex. 1 | A | 30 | 61.0 | 60.9 | 60.9 | 0.1 | 0.09 | A | A | A |
| Ex. 2 | B | 30 | 61.5 | 61.1 | 61.0 | 0.5 | 0.09 | A | A | A |
| Ex. 3 | C | 35 | 50.3 | 50.6 | 50.6 | 0.3 | 0.06 | A | A | A |
| Ex. 4 | D | 20 | 61.4 | 61.9 | 62.0 | 0.6 | 0.10 | A | A | B |
| Ex. 5 | E | 20 | 63.7 | 63.5 | 64.2 | 0.7 | 0.10 | A | B | C |
| Ex. 6 | F | 30 | 62.4 | 63.0 | 63.1 | 0.7 | 0.13 | A | B | C |
| Comp. Ex. 1 | G | 13 | 61.2 | 62.1 | 62.5 | 1.3 | 0.16 | B | B | C |
| Comp. Ex. 2 | H | 30 | 61.7 | 62.2 | 62.5 | 1.2 | 0.12 | B | B | C |
| Comp. Ex. 3 | I | 7 | 65.5 | 65.6 | 66.5 | 1.0 | 0.20 | B | D | D |

As shown in Table 1, it was found that all of fixing belts Nos. 1 to 6 in which a base layer made of a heat-resistant resin, an elastic layer made of an elastic material and a releasing layer were laminated in this order, and in which the difference between the maximum value and the minimum value of the viscoelastic modulus within a range of 100 to 200° C. was 0.8% or less exhibited sufficient performance both in the suppression of gloss unevenness and in separativeness at a temperature of 150° C. in a high-speed image forming apparatus using a biaxial belt type fixing device. One possible reason for this is that the physical properties of the fixing belts did not vary significantly between the time when a toner image was fixed and the time when a toner image was not fixed, and thus the fixing belts that followed the recording medium at the time of fixation had sufficient resilience, which allowed the fixing belts to both follow and be separated from a recording medium. Further, it was found that all of fixing belts Nos. 1 to 5 in which the variation rate of the amount of viscous stress relative to the amount of elastic stress within a range of 100 to 200° C. was 0.1 or less exhibited sufficient performance both in the suppression of gloss unevenness and in separativeness at a temperature of 150° C. in a high-speed image forming apparatus using a biaxial belt type fixing device for the same reason as described above.

Further, fixing belts Nos. 1 to 4 in which the difference between the maximum value and the minimum value of the viscoelastic modulus was 0.6% or less, and in which the viscoelastic modulus within a range of 100 to 200° C. was within a range of 50 to 62% had favorable separativeness even when the fixing belts had a temperature of 200° C. Furthermore, fixing belts Nos. 1 to 3 in which the difference between the maximum value and the minimum value of the viscoelastic modulus was 0.5% or less, and in which the viscoelastic modulus within a range of 100 to 200° C. was within a range of 50 to 62% had more favorable separativeness when the fixing belts had a temperature of 200° C.

In contrast, any of fixing belts Nos. C1 to C3 could not suppress gloss unevenness in a high-speed image forming apparatus using a biaxial belt type fixing device. One possible reason for this is that there was a significant difference between the maximum value and the minimum value of the viscoelastic modulus, and thus the fixing belts that followed the recording medium at the time of fixation failed to generate resilience enough to impart separativeness, so that the exudation amount of wax contained in the toner was decreased, which caused a defect in the separativeness between fixing belts Nos. C1 to C3 and the sheet.

What is claimed is:

1. A fixing belt comprising:

a base layer made of a heat-resistant resin;

an elastic layer made of an elastic material; and a releasing layer, which are laminated in this order, wherein a difference between a maximum value and a minimun value of viscoelastic modulus of the fixing belt is within a range of 100 to 200° C. is 0.8% or less.

2. The fixing belt according to claim 1, wherein the viscoelastic modulus within the range of 100 to 200° C. is within a range of 50 to 62%.

3. The fixing belt according to claim 1, wherein a variation rate of an amount of viscous stress relative to an amount of elastic stress within the range of 100 to 200° C. is 0.1 or less.

4. A fixing device comprising:

an endless fixing belt;

two or more rollers including a heating roller for heating the fixing belt, the two or more rollers pivotally supporting the fixing belt; and a pressure roller disposed to be relatively biased against one of the rollers with the fixing belt being disposed therebetween, wherein the fixing belt is the fixing belt according to claim 1.

5. An image forming apparatus comprising:

an image forming section configured to form a toner image on a recording medium by an electrophotographic process; and the fixing device according to claim 4, configured to heat and press an unfixed toner image formed on the recording medium to fix the unfixed toner image on the recording medium.

* * * * *